United States Patent [19]

Asick et al.

[11] Patent Number: 4,772,211

[45] Date of Patent: Sep. 20, 1988

[54] MULTI-PLANE INTERCONNECTION SYSTEM

[75] Inventors: John C. Asick, Harrisburg; George H. Douty, Mifflintown, both of Pa.; Joseph R. Goodman, Walkertown, N.C.; Kermit M. Jones, Jr.; John M. Landis, both of Camp Hill, Pa.; Clair W. Snyder, Jr., York, Pa.; John A. Woratyla, Camp Hill, Pa.; Dale R. Zell, Elizabethtown, Pa.

[73] Assignee: AMP Incorporated, Harrisburg, Pa.

[21] Appl. No.: 68,744

[22] Filed: Jun. 30, 1987

Related U.S. Application Data

[63] Continuation of Ser. No. 853,386, Apr. 17, 1986, abandoned, which is a continuation of Ser. No. 718,058, Mar. 29, 1985, abandoned, which is a continuation of Ser. No. 505,150, Jun. 17, 1983, abandoned.

[51] Int. Cl.[4] ..... H01R 9/09

[52] U.S. Cl. ..... 439/65; 439/545; 439/660

[58] Field of Search ..... 339/17 CL, 17 LM, 17 M, 339/19, 176 M, 176 MP, 198 R, 198 P, 198 S; 439/65–78, 545, 660

[56] References Cited

U.S. PATENT DOCUMENTS

| | | | |
|---|---|---|---|
| 2,886,793 | 5/1959 | Katzman et al. | 339/58 |
| 3,017,469 | 1/1962 | Giller | 339/75 R |
| 3,283,108 | 11/1966 | Collier | 339/17 R |
| 3,299,392 | 1/1967 | Evans | 339/176 M |
| 3,404,367 | 10/1968 | Henschen | 339/217 |
| 3,555,497 | 1/1971 | Watanabe | 339/258 R |
| 3,594,696 | 7/1971 | Witek, Jr. | 339/94 M |
| 3,634,816 | 1/1972 | Zell | 339/186 M |
| 3,812,450 | 5/1974 | Simovits, Jr. et al. | 339/128 |
| 3,816,821 | 6/1974 | Rhodes | 339/198 R |
| 4,133,592 | 6/1977 | Cobaugh et al. | 339/17 M |
| 4,186,982 | 2/1980 | Cobaugh et al. | 339/17 C |
| 4,201,432 | 5/1980 | Chalmers | 339/176 M |
| 4,363,530 | 12/1982 | Verhoeven | 339/17 C |
| 4,384,754 | 5/1983 | Douty et al. | 339/17 M |
| 4,390,224 | 6/1983 | Showman et al. | 339/17 LC |
| 4,482,938 | 11/1984 | Norden | 361/394 |
| 4,489,998 | 12/1984 | Asick et al. | 339/19 |
| 4,490,000 | 12/1984 | Asick et al. | 339/19 |

FOREIGN PATENT DOCUMENTS

| | | | |
|---|---|---|---|
| 580342 | 9/1976 | Switzerland | 339/198 R |

*Primary Examiner*—Neil Abrams

*Attorney, Agent, or Firm*—David L. Smith; Anton P. Ness

[57] ABSTRACT

A multi plane connector system is formed by a header assembly mounted on at least one side of a circuit board and a connector commoning terminals of header assemblies on adjacent circuit boards. The terminals of the header assemblies can either be through-the-board mounted or surface mounted in either a soldered or spring loaded condition. The connector preferably includes latching means and can be back plane or ground plane mounted.

13 Claims, 2 Drawing Sheets

Fig. 1
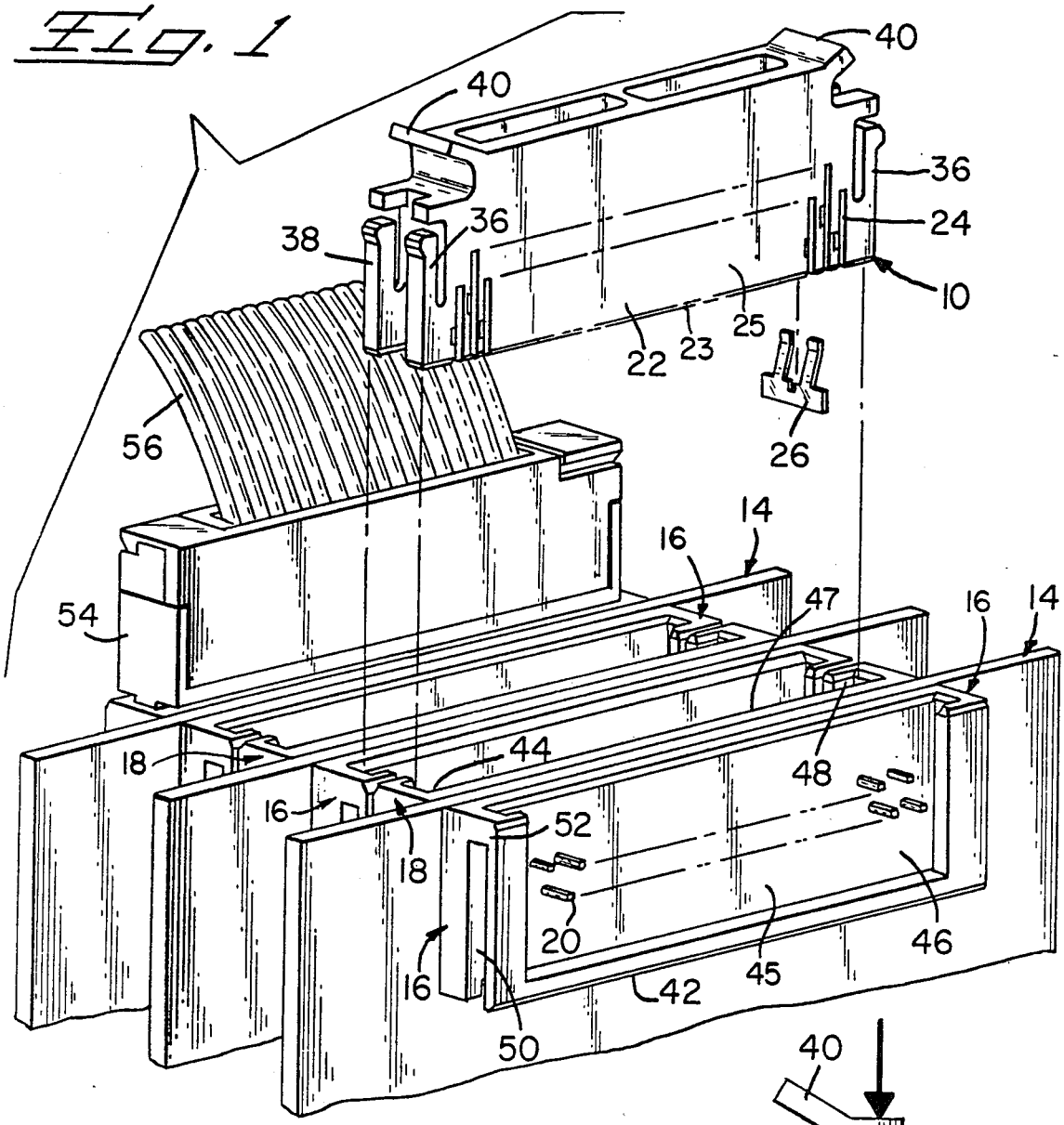
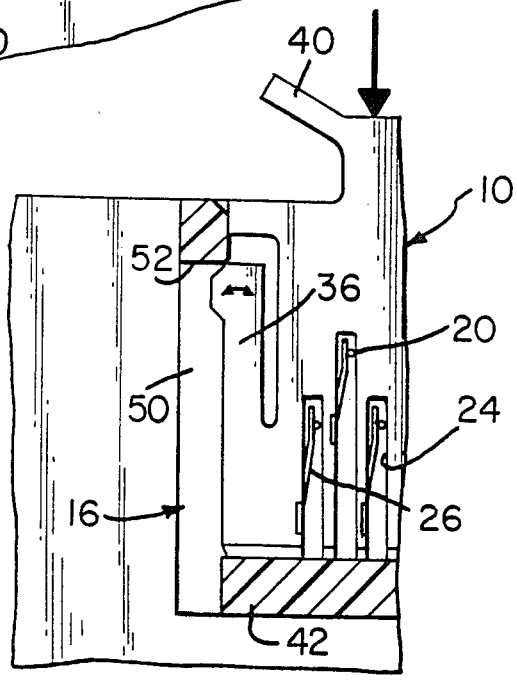
Fig. 2

Fig. 3
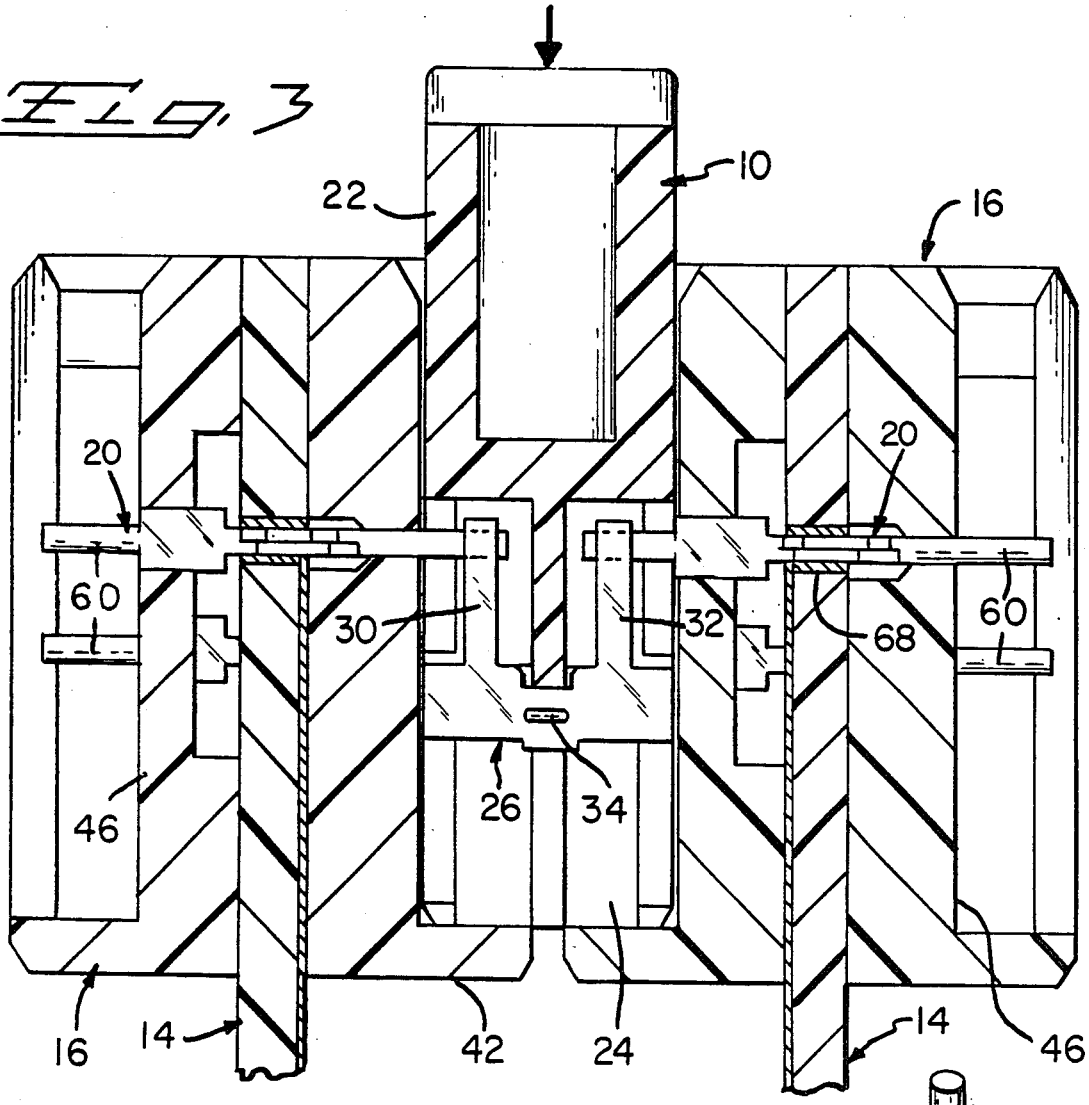
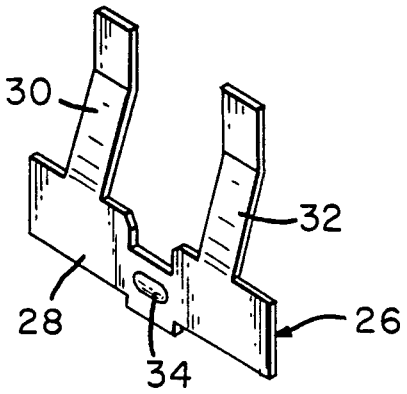
Fig. 4
Fig. 5
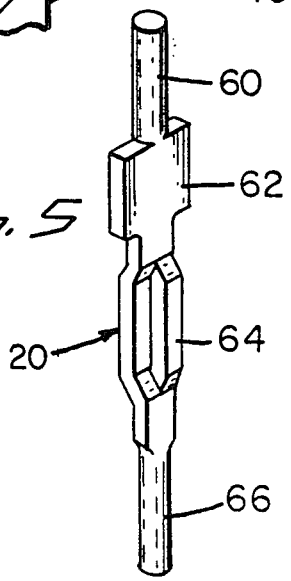

MULTI-PLANE INTERCONNECTION SYSTEM

This application is a continuation of Application Ser. No. 853,386 filed Apr. 17, 1986, now abandoned, which is a continutation of Application Ser. No. 718,058 filed Mar. 29, 1985, now abandoned, which is a continuation of Application Ser. No. 505,150 filed June 17, 1983, now abandoned.

The present invention relates to a system for electrically and mechanically interconnecting multiple closely spaced devices, such as circuit boards, and in particular to a system which allows for a wide variety of interconnection embodiments.

The present invention is an improvement of the invention described in U.S. Pat. No. 4,489,998.

The current state of electronics technology requires the maximum number of interconnects in the minimum amount of space. The connector systems heretofor available have not been able to fulfill these requirements.

The present invention concerns a multi-plane interconnection system comprising a connector member mating with a head assembly mounted on a circuit board or the like. Each connector member carries therein a plurality of electrical terminals, each having at least one portion profiled to mate with a terminal mounted in the header assembly. The terminal of the connector member can also mate with an individual conductor or a further terminal. The header assembly includes at least one header member mounted on a first side of a circuit board or the like and containing a plurality of pin terminals which are electrically and mechanically connected to circuitry on the circuit board, The header assembly can also include a pin shroud which would be mounted on the opposite side of the circuit board from the pin header and have a second array of pin terminals associated therewith or receive the opposite end of the pin terminals mounted in the pin header and extending through the circuit board.

Embodiments of the present invention will now be described by way of example with reference to the accompanying drawings, in which:

FIG. 1 is a persepctive view of thes ubject system with one connector member exploded from a header assembly and a terminal exploded from the connector member;

FIG. 2 is a longitudinal section through an end portion of the headed and connector member of FIG. 1 in a mated condition;

FIG. 3 is a transverse section through the present invention in a mated condition;

FIG. 4 is a perspective view of a terminal used in the connector member of FIGS. 1 to 3;

FIG. 5 is a perspective view of a pin terminal shown in the header assembly of FIGS. 1 to 3;

FIG. 6 is a transverse section through an alternate embodiment of the subject header assembly;

FIG. 7 is a perspective view of a surface mount terminal of FIG. 6;

FIG. 8 is a perspective view of an alternate embodiment of the present invention utilized in a back-plane mounting mode;

FIG. 9 is a perspective view of an alternate mounting of the subject connector member prior to being assembled into a ground plane; and FIG. 10 is a view similar to FIG. 9 showing the connector member in a fully mounted position.

The subject multi-plane interconnect system is shown in FIG. 1 with a connector member 10 exploded from a header member 16 and a shroud 18 mounted on parallel circuit boards 14. The header member 16 has a planar mating face 45 in a connector-receiving cavity 46 which is profiled to receive a mating connector 10, 54 in a mating direction parallel to the mating face 45. The shroud 18 has a mating face 47 in a connector-receiving cavity 48, which is profiled to receive a mating connector 10, 54 in a mating direction parallel to mating face 47. A plurality of contacts in the form of pin terminals 20 extend normally of each mating face 45, 57 in two parallel rows aligned normally of the mating direction a first distance apart. Adjacent contact in each row are spaced a second distance apart, the contacts in one row being staggered from the contacts in the other row. The connector member 10 connects terminals 20 in a header member 16 and terminals 20 in a shroud 18 on adjacent circuit boards 14. The connector member 10 comprises a housing 22 having a mating end 23 profiled for reception in cavities 46, 48 and opposed mating surfaces 25 for reception against mating faces 45, 47. A row of parallel slots 24 spaced at half the second distance apart extends from the mating end 23 rearward of the mating direction and opens on each mating surface 25. Each slot 24 receives a terminal 26 therein from mating end 23.

Referring also to FIGS. 2, 3 and 4, each terminal 26 comprises a body 28 having a detent 34 which secures it in a respective slot 24. The body 28 supports the terminal 26 toward mating end 23, and a pair of parallel cantilever arms 30, 32 which extend freely rearward of the mating direction. Each slot 24 thus receives two arms 30, 32, each arm being adjacent a respective mating surface 25 on which the slot 24 opens. The arms 30, 32 are resiliently biased to engage respective contacts 20 when the mating end 23 is received in cavities 46, 48. The arms 30, 32 in alternate slots 24 adjacent one mating surface 25 engage contacts 20 in one row, the arms in remaining slots 24 adjacent the same surface 25 engaging contacts 20 in the other row. At each end of housing 22 there is a pair of latching arms 36, 38 and an extraction handle 40.

Both the pin header 16 and the shroud 18 have elongated housings 42, 44, respectively, of rigid insulative material defining a reception cavity 46, 48, respectively, and each has a latching recess 50, see FIG. 2, defining a shoulder 52.

It will be noted from FIG. 2 that the connector member 10 is received in the respective pin header 16 or shroud 18 and secured therein by engagement of the latching arms 36, 38 against the shoulders 52 at ends of the recesses 50.

FIG. 1 also shows an I/O connector 54 which engages with a single pin header 16 or shroud 18 and makes an interconnection with the pin terminals 20 therein to a multi-conductor cable 56.

FIGS. 3 to 5 further illustrate the primary embodiment of the present invention. The terminal 26 of the connector 10 is shown in detail in FIG. 4 and a pin terminal 20 is shown in FIG. 5. The pin terminal 20 has a first mating end 60, an intermediate portion 62, a compliant mounting section 64, and a second pin portion 66.

It will be seen from FIG. 3 that the pin terminal 20 is mounted by the compliant section 64 in a conductive aperture 68 of each respective circuit board 14, with the pin portions 60, 66, respectively, extending beyond the mating faces 45, 47 of the pin header 16 and shroud 18.

The connector member 10 can be easily inserted between closely spaced circuit boards 14 with terminals 26 making wiping interconnection with the pins 20.

An alternative embodiment is shown in FIGS. 6 and 7 with the pin terminal 20 of FIG. 5 being replaced by a surface mount pin terminal 70. In this instance the headers 72, 74 are almost identical to the previously described pin headers 16 in that they are elongated members of rigid insulative material each with a connector receiving face 74, 76 and a mounting face 78, 80 with a plurality of terminal passages 82, 84 extending therebetween. The terminal 70 is a stamped and formed terminal having a mating portion 86, a mounting tail 88 and latching lugs 90. The mounting tail 88 can either be left straight and secured to the circuit board 14 by known means, such as solder, as shown on the left hand side of FIG. 6, or can be profiled so that its end 92 projects into an aperture 94 in the header 72 forming a projecting resilient bend 96 obviating the need to solder the mounting tail 88 to the circuit board 14. The header 72 would be secured to the circuit board 14 by conventional means (not shown).

FIG. 8 is another alternate embodiment of the present invention. In this embodiment the connector member 10 has been modified to serve as a backplane connector member 98 by adding mounting tabs 100 at the ends of the elongated housing of rigid insulative material to secure the connector member 98 to a frame 102. In this embodiment the connector member 98 remains fixed and circuit boards 14 carrying the pin headers 16 and shrouds 18 would be moved into an engaging position with the connector 98.

FIGS. 9 and 10 show another alternate embodiment of the connector member 10. In this embodiment the connector member 104 is to be mounted in a profiled aperture 106 of a planar member 108. Each end of the connector member 104 is profiled with a slot 110 which receives an edge of the member 108 at the periphery of the aperture 106. The connector member 104 is provided with latching arms 112 which engage in apertures 114 in the member 108 when the connector member 104 is fully positioned, as shown in FIG. 10.

We claim:

1. A connector system for interconnecting a plurality of closely spaced circuit paths of a printed circuit panel at an edge thereof, comprising;

a header member mounted on the edge of a printed circuit panel and having a substantially planar mating face in a connector receiving cavity profiled to receive a mating connector in a mating direction parallel to said mating face, said mating face being parallel to said printed circuit panel, a plurality of contacts secured in said headed member and electrically connected to respective circuit paths of the printed circuit panel, said contacts including pin contact sections extending substantially normally outwardly from said mating face and within said connector receiving cavity and arranged in two parallel rows spaced a first distance apart and aligned normally of said mating direction, adjacent ones of said pin contact sections in each row being spaced a second distance apart, and said pin contact sections in one said row being staggered from said pin contact sections in the other said row, a connector member including a housing having a mating end profiled for reception into said connector receiving cavity of said header member, and including a mating surface associated with said header mating face and receivable therealong and disposed adjacent thereto during and after mating, a plurality of terminals secured in said housing and including respective first contact sections associated with said pin contact sections of said contacts of said header for electrical engagement therewith upon mating of said connector member and said header, said terminals including second contact sections electrically connectable to contact means of other electrical connector means, said housing including a plurality of parallel slots along said mating surface extending rearwardly from said mating end and adapted and spaced to correspond with and receive thereinto respective said pin contact sections of said header during mating, said first contact sections of said connector member comprising cantilever arms recessed within respective said slots and disposed therein in a manner enabling resilient deflection laterally within said slots by corresponding said header pin contact sections during mating, said arms of said terminals in alternate slots engaging adjacent and header pin contact sections in one said row thereof and said arms in remaining slots engaging adjacent said header pin contact sections in the other said row thereof;

whereby interconnection of closely spaced circuit paths of the printed circuit panel and terminals of the connector is facilitated where the connector member has a low profile and minimal size with the contact sections thereof supported and separated by dielectric material, and the connector member mates with the header member in a direction parallel to the panel, for use in an environment of limited space.

2. A connector system as in claim 1 wherein said connector member comprises a further mating surface opposite said mating surface, each said slot opening also on the further mating surface, each said terminal having said second contact sections in a respective slot adjacent said further mating surface, whereby the further mating surface is received in a cavity against a mating face of an adjacent electrical connector means and the terminals interconnect a contact on the header member with contact means on an adjacent electrical connector means.

3. A connector system as in claim 2 wherein said first and second contact sections are parallel.

4. A connector system as in claim 2, further comprising:

a shroud, said shroud mounted on the edge of a printed circuit panel and having a substantially planar mating face in a connector receiving cavity profiled to receive a mating connector in a mating direction parallel to said mating face, said mating face being parallel to the printed circuit panel on which said shroud is mounted, and a plurality of contacts secured in said shroud and electrically connected to respective circuit paths of the printed circuit panel on which said shroud is mounted, said contacts including pin contact sections extending substantially normally outwardly from said mating face and within said connector receiving cavity and arranged in two parallel rows spaced a first distance apart and aligned normally of said mating direction, adjacent ones of said pin contact sections in each row being spaced a second distance apart, and said pin contact sections in one said row being staggered from said pin contact sections in the other said row, whereby when the connector member is received along the mating face of the header member and shroud, the pin contacts on both the header and shroud are received in the slots and the terminals therein electrically interconnect a pin contact on the header member with a respective pin contact on the shroud thereby interconnecting circuit paths on the printed circuit panel on which the header member is mounted with respective circuit paths on the printed circuit panel on which the shroud is mounted.

5. A connector system as in claim 1 wherein the cantilever arms in alternate slots are supported at a like depth from said mating end, the cantilever arms in remaining slots being supported at said second distance from said like depth.

6. A connector system as in claim 1 wherein alternate slots extend inward a like depth from the mating end, the remaining slots extending inward substantially said second distance from said like depth.

7. A connector system as in claim 1 wherein all terminals are identical.

8. A connector system as in claim 1 wherein all terminals are received in said slots from said mating end.

9. A connector system as in claim 1 wherein the cantilever arms are supported toward said mating end and extend freely rearward of the mating direction therefrom.

10. A connector system comprising:

a header member having a substantially planar mating face in a connector receiving cavity profiled to receive a mating connector in a mating direction parallel to said mating face;

a plurality of contacts extending substantially normally of the mating face in two parallel rows aligned normally of the mating direction a first distance apart, adjacent contacts in each row being spaced a second distance apart, the contacts in one row being staggered from the contacts in the other row;

a connector member comprising a housing having a mating end profiled for reception in said cavity and a mating surface for reception against said mating face, a row of parallel slots spaced to correspond to the lateral spacing of the two rows of header member contacts as viewed from the mating direction, said slots extending along the mating direction rearwardly from the mating end and opening onto the mating surface, said housing having a further mating surface opposite said mating surface, each said slot opening also on the further mating surface, each said terminal having a further cantilever arm in a respective slot adjacent said further mating surface, whereby the further mating surface is received in a cavity against a mating face of an adjacent shroud member and the cantilever arms electrically interconnect a contact on the header member with a contact on an adjacent shroud member; and a plurality of terminals in said housing, each terminal having a cantilever arm in a respective slot adjacent said mating surface, the arms adapted to be resiliently biased laterally by respective contacts when engaged therewith upon reception of said mating end in said cavity, the arms in alternate slots engaging adjacent contacts in one row, the arms in remaining slots engaging contacts in the other row, whereby interconnection of closely spaced pin contacts of the header member and terminals of the connector member is facilitated where the connector system has a lower profile and minimal size with the terminals thereof supported and separated by dielectric material, the connector member mates with the header member in a direction parallel to the mating face, for use in an environment of limited space.

11. A connector system as in claim 10 wherein said arms are parallel.

12. A connector system as recited in claim 10 further comprising:

a shroud, said shroud having a substantially planar mating face in a connector-receiving cavity profiled to receive a mating connector in a mating direction parallel to said mating face, said shroud adjacent to said header member with the mating faces thereof substantially parallel; and a plurality of contacts extending substantially normally of the mating face of said shroud in two parallel rows aligned normally of the mating direction said first distance apart, adjacent contacts in each row being spaced said second distance apart, the contacts in one row being staggered from the contacts in the other row, whereby when the connector member is inserted along the mating face of the header member and shroud, the contacts on both the header and shroud are received in the slots and the terminal therein electrically interconnects a contact on the header member with a contact on the shroud.

13. A connector system as recited in claim 12 wherein a contact extending from the mating face of the header and received in one of said slots is electrically interconnected with a contact extending from the mating face of the shroud and received in said one of said slots.

* * * * *

UNITED STATES PATENT OFFICE

CERTIFICATE OF CORRECTION

Patent No. 4,772,211 Dated September 20, 1988

Inventor(s) John C. Asick, George H. Douty, Joseph R. Goodman, Kermit M. Jones, Jr., John M. Landis, Clair W. Snyder, Jr., John A. Woratyla and Dale R. Zell It is certified that error appears in the above-identified patent and that said Letters Patent is hereby corrected as shown below:

Claim 1, Column 3, Line 53 - The word "headed" should be --header--.

Signed and Sealed this

Thirty-first Day of March, 1992

*Attest:*

*Attesting Officer*

HARRY F. MANBECK, JR.

*Commissioner of Patents and Trademarks*